US005492225A

United States Patent [19]

Musselmann et al.

[11] Patent Number: 5,492,225

[45] Date of Patent: Feb. 20, 1996

[54] SORTER HAVING A HOUSING WITH CONICAL SHAPED END WALL

[75] Inventors: Walter Musselmann; Reimund Rienecker, both of Heidenheim, Germany

[73] Assignee: J. M. Voith GmbH, Heidenheim, Germany

[21] Appl. No.: 285,170

[22] Filed: Aug. 3, 1994

[30] Foreign Application Priority Data

Aug. 6, 1993 [DE] Germany ..... 43 26 411.5

[51] Int. Cl.[6] ..... B07B 1/04; B01D 21/02

[52] U.S. Cl. ..... 209/273; 209/283; 209/300; 210/413

[58] Field of Search ..... 209/268, 273, 209/274, 281, 283, 284, 285, 300; 210/413, 414, 415

[56] References Cited

U.S. PATENT DOCUMENTS

| | | | |
|---|---|---|---|
| 3,376,976 | 4/1968 | Wallen | 209/300 X |
| 3,928,188 | 12/1975 | Link et al. | 209/300 X |
| 4,238,324 | 12/1980 | Musselmann et al. | 209/273 X |
| 4,961,844 | 10/1990 | Ekholm et al. | 209/273 |
| 5,072,834 | 12/1991 | Suica et al. | 209/273 |

FOREIGN PATENT DOCUMENTS

| | | | |
|---|---|---|---|
| 2548578 | 12/1978 | Germany . | |
| 1687303 | 10/1991 | U.S.S.R. | 209/273 |

*Primary Examiner*—William E. Terrell
*Assistant Examiner*—Tuan Nguyen
*Attorney, Agent, or Firm*—Baker & Daniels

[57] ABSTRACT

A sorter with a symmetric screen which is arranged concentrically in an essentially symmetric housing, and in the interior of which there is contained a concentric rotor drum that features on its periphery sorting elements sweeping across the screen, circulating at least parts of the suspension being sorted around the walls of the drum. The sorting elements are of a design such that they will generate a vortex flow of the suspension in the housing. The housing features at its periphery at least one removal duct for heavy contaminants and, in one of its end walls, a central lightweight dirt drain. The housing end wall that features the lightweight dirt drain has, in the direction away from the screen and the rotor drum, from radially outside to radially inside, a diameter that tapers in conic fashion by maximally 11 mm per each 3 mm of axial housing length, and minimally by 2 mm per each 3 mm of axial housing length.

8 Claims, 1 Drawing Sheet

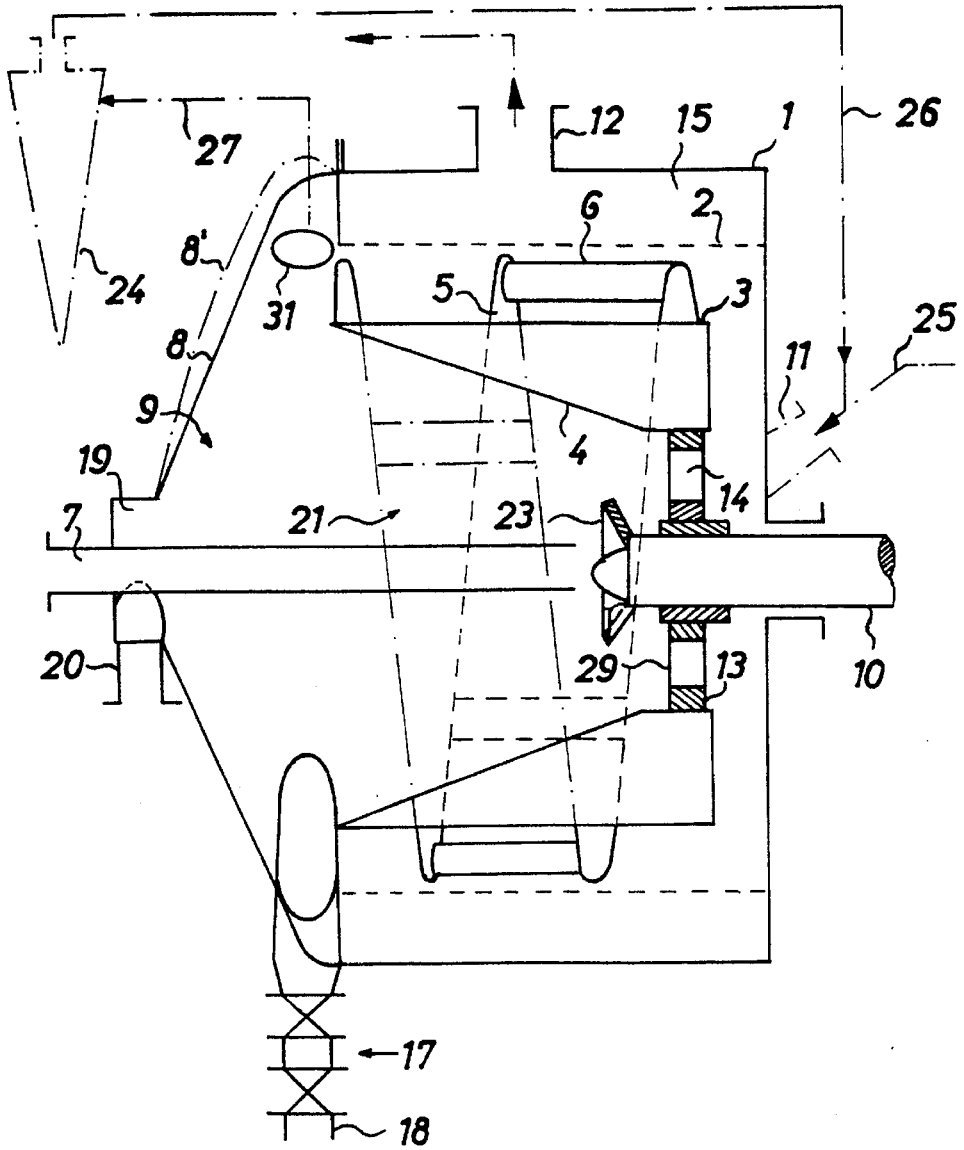
Fig. 1
Fig. 2
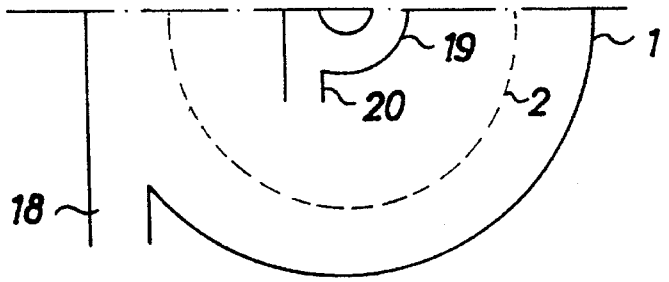

SORTER HAVING A HOUSING WITH CONICAL SHAPED END WALL

BACKGROUND OF THE INVENTION

The invention concerns a sorter with a symmetric screen which is arranged concentrically in an essentially symmetric housing. In the interior of the housing there is concentrically contained a rotor drum featuring on its outer circumference sorting elements that sweep across the screen and circulate at least parts of the suspension being sorted around the walls of the drum. The sorting elements have a design such that they generate a vortex flow of the suspension in the housing. The housing features on its periphery at least a removal duct for heavy contaminants, and in one of its end walls a central lightweight dirt drain.

A sorter of that type is known from DE-C 25 48 578. On this sorter, the drum supports the sorting elements, which are installed in the screen space formed between the drum and the screen concentrically surrounding it. The drum and the sorting elements are part of the rotor, the axis of rotation of which essentially coincides with the longitudinal axis of the screen basket, which at the same time also is the axis of rotational symmetry of the screen basket. This arrangement creates a recirculation of the suspension—preferably fiber suspension in the waste paper industry—between screen space and drum interior, that is, practically around the walls of the drum. This is meant to improve the separation of contaminants. In this described arrangement, the removal space for the heavy contaminants borders on the housing area which accommodates the screen and the drum and is relatively narrow, the outside diameter of the housing being considerably larger than the largest inside diameter of the cylindrical screen. The lightweight contaminants are removed from the central, axial area of the housing on an end wall of it, which is located opposite the end wall adjacent to the inlet space of the housing.

The problem underlying the invention is to provide an arrangement for the separation of fiber suspensions which are heavily laden with contaminants, especially for an end-stage sorting. By "end-stage sorting" is meant the process step in which the collected reject shares of the individual sorting stages are to be cleaned once again in order to reclaim usable fibers. Such a machine would then be able to additionally clean suspensions with a medium-heavy content of contaminants.

SUMMARY OF THE INVENTION

This problem is solved by the features of the present invention. The housing end wall that features the lightweight dirt drain has a diameter—in the direction away from the screen and the rotor drum, from radially outside to radially inside—which tapers maximally by 11 mm per each 3 mm of axial length and minimally by 2 mm per each 3 mm of axial housing length, i.e., it is of conic design.

The conic design of the interior of the drum prevents the contaminants from forming an adhering layer on the inside wall of the drum. When fashioning the housing end side that borders on the large diameter of the drum interior with a conic end wall that tapers away from the drum, the result will be that relatively small, heavy contaminants will be separated along this wall and can be removed along with the share of lightweight contaminants, which preferably is to be provided for also on this end side of the housing.

Provided as carriers for the sorting elements which sweep across the screen are favorably helical walls which are arranged at least on the end sections of the drum. A rotor of such design prevents contaminants from sticking to the sorting elements or their carriers and results in the recirculation of the particles retained on the screen. The length of the drum in this design essentially equals at least the axial length of the screen, which preferably is designed as a cylindrical screen.

BRIEF DESCRIPTION OF THE DRAWINGS

The invention will be explained hereafter with the aid of the drawings.

FIG. 1 shows basically an axial section through the inventional sorter.

FIG. 2 shows a side view of the housing.

DETAILED DESCRIPTION OF THE INVENTION

Contained in the cylindrical housing 1 of the sorter, coaxially, is a cylindrical screen 2 in the interior of which the rotor is provided. The rotor consists essentially of the rotor drum 3, the helical surfaces—or walls—5 supported by it, and the sorting elements 6 mounted on the walls, which preferably have the shape of hydrofoils. The rotor is driven by the shaft 10, the shaft being joined to the drum 3 by way of a support disk 13 which essentially extends radially. The support disk 13 is provided with apertures 14 so as to enable the circulation of the suspension from the screen space to the drum interior 21. The interior 21 is conic and flares in funnel fashion toward the free end of the drum 3, where the entrance end of the screen space contained in the interior of the screen is located. That is, it is that end of the drum arranged opposite to the end provided with the support disk 13. On this end also exists a vortex space 9 which has an outside diameter that is larger than the inside diameter of the screen—which generally is the largest inside diameter. The end wall 8 bounding the vortex space 9 at the housing end also has a conic design. Its diameter reduction—away from the interior 21 of the drum—amounts to maximally 11 mm per each 3 mm of axial housing length and minimally 2 mm per each 3 mm of axial length of the housing, producing an inclination of about 15° to 33.5°. As indicated at 8' this end wall may also be modeled on a basket arc or an exponential (E) function. The end wall extends in both cases radially outward, in arched fashion, in the cylindrical housing wall. Another option is designing the drum outside wall identical to the progression of the inside wall 4, that is, conic as well.

Two options are available for feeding the suspension, which are indicated in FIG. 1. The first option is the central feeding through a pipe 7 which protrudes into the drum interior 21. Provided opposite the pipe end is a dish type baffle 23 which is fastened to the shaft 10, but may be joined also to the support disk 13. The stock is accelerated radially outward by it so as to support, or amplify, the vortex flow of the suspension also in the interior of the drum 21. A further amplification of the vortex flow in the drum interior is brought about by the ribs 29 that exist between the apertures 14 in the support disk 13. A vortex flow is also created by the drum itself. The accepts are removed via socket 12.

Another option of introducing the stock into the housing 1 is indicated by dash-dot line, through the socket 11, which should be arranged as near as possible to the rotor axis. Owing to the rotational flow in the housing, the lowest static pressure prevails here. As indicated likewise, the stock heavily laden with particles and removed at 31 can be subjected to an additional recleaning by means of hydrocyclone 24; the accepts may be recycled by way of line 26 into the suspension feed line 25.

As generally known, the lightweight contaminants accumulate in the center of the housing, i.e., in the vortex flow, and are removed via socket 20 from the collection space 19 provided therefor. Heavy contaminants, which preferably accumulate radially outside, are removed through the line 18 provided with a lock 17. Heavy contaminants with small diameters are separated into the vortex space 9 and migrate along the wall 8, respectively 8', also into the collection space 19. These contaminants may also be removed by way of socket 20.

As can be seen from FIG. 2, the removal sockets 18 and 20 are joined to the housing preferably in tangential fashion. It is noted further that in the case of the stock feeding socket 11 indicated by dash-dot line, the central line 7 and the dish-type baffle 23 are dispensable. In this case, the removal socket 20 for the lightweight contaminants may be arranged at the location of line 7.

The following guide values may be assumed for the perforation of the screen drum 2: in the case of slits, a slit width between 0.2 and 0.4 mm; if the sorter is intended for perforation sorting in keeping with the stock to be cleaned, holes measuring between 1.4 and 2 mm in diameter. The inclination of the drum cone may amount to between 10° and 30° relative to the axis of rotation. The maximum velocity at the rotor, that is, of the outermost areas of the screen elements 6, or helical walls 5, may preferably range between 15 and 20 m/s.

Obtained overall is an operationally reliable machine with a relatively high throughput and, due to the continual recirculation of the material retained on the screen, there occurs hardly any fractioning effect. With this machine of a relatively simple structure it is possible to reclaim most of the fibers in the end stage in favorable fashion.

What is claimed is:

1. A sorter for sorting a suspension, comprising:

a generally symmetric housing, said housing having an end wall and having an axial length;

a symmetric screen, said screen arranged interiorly of and concentric to said housing;

a rotor comprising a rotor drum, said drum concentrically contained interiorly of said screen, said drum having an interior wall, axial ends and an outer circumference, said rotor comprising sorting elements arranged at said outer circumference of the rotor drum, said sorting elements operable to sweep across the screen and circulate around the wall of the drum at least a portion of the suspension being sorted, said sorting elements having a configuration such that a vortex flow of the suspension is generated in a space at an end wall of said housing, said drum interior wall having a conic configuration such that a conic interior space is defined thereby, said conic interior space having an end adjacent to said vortex flow space and having an opposite end, said adjacent end having a larger diameter than said opposite end, thereby forming a conic flow space for said suspension, the diameter of said conic flow space on a suspension feed end of the sorter being smaller than a diameter on an opposite end; and wherein a removal space and removal socket for lightweight contaminants are disposed at said housing end where the vortex space is generated;

a removal duct located at a peripheral portion of the housing for removing heavy contaminants; and a dirt drain for lightweight particles, said dirt drain being generally centrally-arranged at said housing end wall, said end wall having a conic configuration and having a diameter which tapers maximally by 11 mm per each 3 mm of axial housing length and minimally by 2 mm per each 3 mm of axial housing length, in a direction away from said screen and rotor drum.

2. The sorter of claim 1, wherein said screen has an inside diameter, and wherein said vortex flow space axially borders on the drum interior and on an end of said screen adjacent to the lightweight contaminants removal socket, said vortex flow space having a maximum outside diameter at least 300 mm larger than the inside diameter of the screen, said inside diameter measured on said end of the screen adjacent to the vortex space, and which, rounded on the outside diameter, extends into the cylindrical housing part.

3. The sorter of claim 2, wherein said housing has an outside diameter, and said housing end wall is configured in a basket arc or conforming to an E-function, with a rounded transition on said outside diameter of the housing.

4. The sorter of claim 1, further comprising a central feed pipe for feeding stock suspension through the vortex flow space into the interior of the drum.

5. The sorter of claim 1, wherein said housing has an opposite end wall, and wherein stock suspension is fed into said housing at said opposite end wall.

6. The sorter of claim 4, wherein said rotor drum comprises a portion of a rotor, said sorter further including a funnel-type baffle dish positioned generally opposite the central feed pipe, said baffle being fastened to the rotor and the shaft; supporting the rotor.

7. The sorter of claim 1, further comprising helical surfaces arranged and fastened at least in the area of the axial ends of the rotor drum, said sorting elements supported by said helical surfaces.

8. The sorter of claim 7, wherein the sorting elements are hydrofoils.

* * * * *